United States Patent [19]

Davis, Jr.

[11] 4,273,269

[45] * Jun. 16, 1981

[54] HAND HELD ELECTRIC CAULKING GUN

[76] Inventor: George B. Davis, Jr., 7512 Marbury Rd., Bethesda, Md. 20034

[ * ] Notice: The portion of the term of this patent subsequent to Oct. 16, 1996, has been disclaimed.

[21] Appl. No.: 61,863

[22] Filed: Jul. 30, 1979

Related U.S. Application Data

[63] Continuation-in-part of Ser. No. 876,048, Feb. 8, 1978, Pat. No. 4,171,072.

[51] Int. Cl.[3] ..... B67D 5/46

[52] U.S. Cl. ..... 222/326; 222/333; 222/391

[58] Field of Search ..... 222/333, 391, 325-327; 74/125, 125.5, 122

[56] References Cited

U.S. PATENT DOCUMENTS

| | | | |
|---|---|---|---|
| 2,367,346 | 1/1945 | Good | 222/391 X |
| 2,928,574 | 3/1960 | Wagner | 222/333 X |
| 3,401,847 | 9/1968 | Downing | 222/391 X |
| 4,072,254 | 2/1978 | Cox | 222/391 |
| 4,171,027 | 10/1979 | Davis, Jr. | 222/326 |

*Primary Examiner*—Charles A. Marmor

[57] ABSTRACT

A hand-held electric caulking gun wherein a caulk-driving piston is forced through the caulk-retaining receptacle of the gun in a manner to force caulking from the gun with considerable force and at a continuous easy-to-control flow. The gun includes a spring type clutch linkage that operates to yieldably disengage the drive source from the piston should the reacting force against the caulk driving end of the piston exceed a predetermined value and a releasing device for allowing the piston to be disengaged of its drive linkage for allowing manual movement of the piston through the gun.

33 Claims, 8 Drawing Figures

FIG. 4
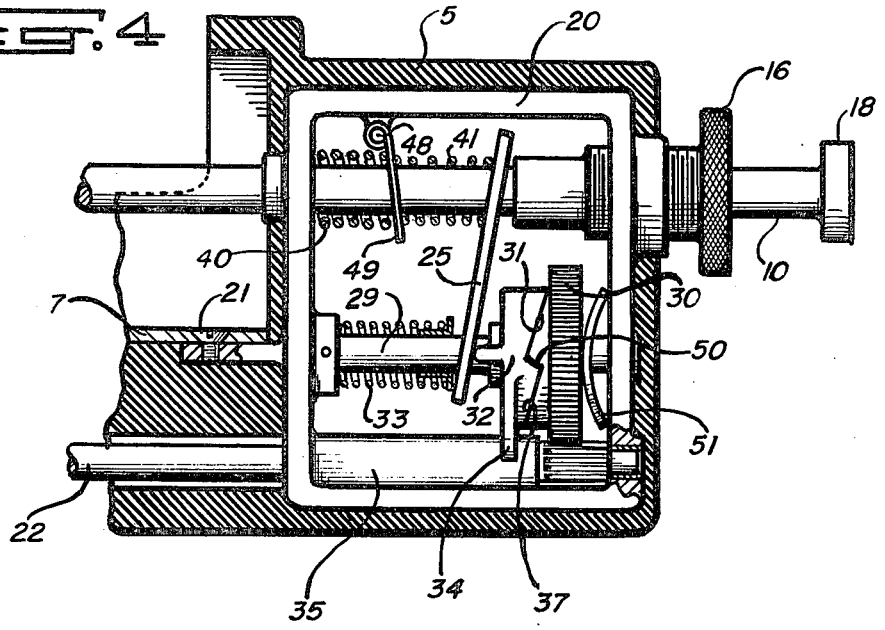
FIG. 5
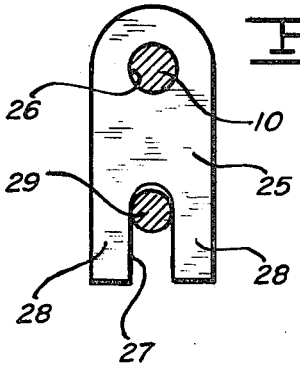
FIG. 8
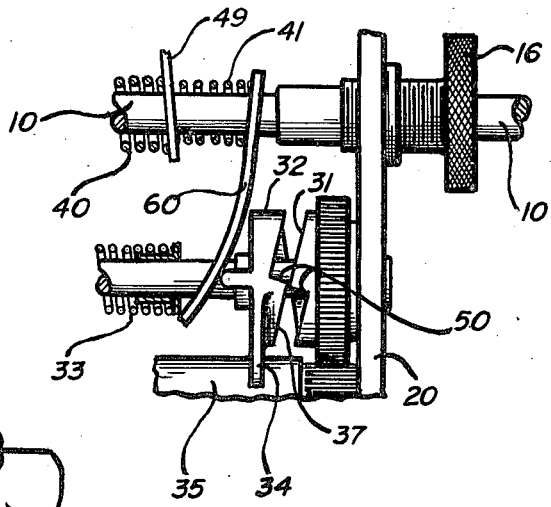
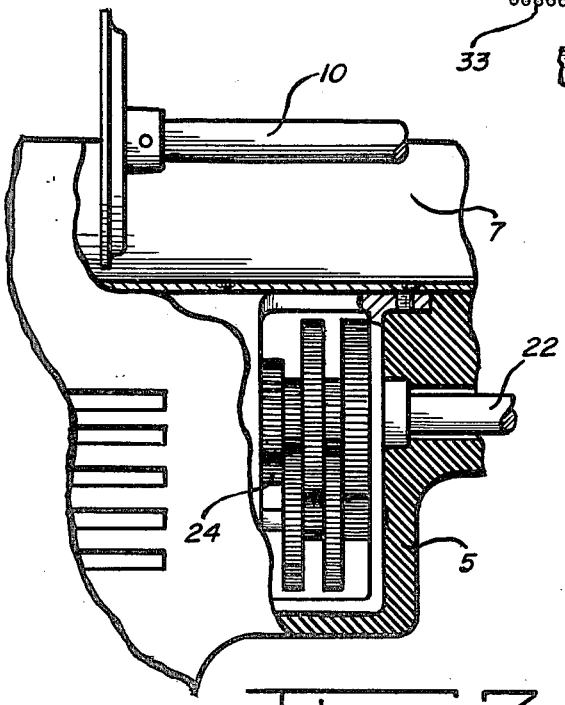
FIG. 7
FIG. 6
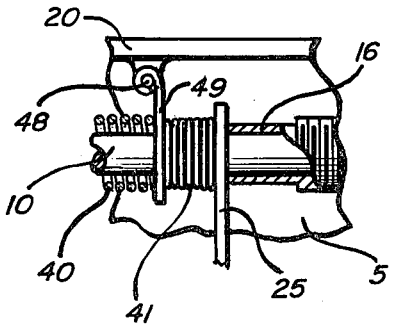

HAND HELD ELECTRIC CAULKING GUN

This application is a continuation in part of application Ser. No. 876,048 Feb. 8, 1978, now matured into U.S. Pat. No. 4,171,072.

Caulking guns are well known in the art and are designed primarily for dispensing caulking that comes prepackaged within a cylindrical-like container or cartridge having projecting therefrom a dispensing nozzle through which the caulking is forced during the caulking operation. These guns include a receptacle wherein is received the cartridge with means being provided for driving a piston-like member through the cartridge thusly forcing the caulking from the nozzle.

Generally the piston of such apparatus is driven by variously constructed hand operated leverage mechanisms which serve to multiply the force applied, to more easily urge the piston through the cartridge. It is well known, however, that even with the mechanical advantage offered by such force multiplying mechanisms the effort required to drive the piston is considerable and frequently beyond the gripping capability of many, particularly the aged or those crippled as with arthritis or the like. Yet in many instances the very livelihood of such individuals with trades such as painters, boatmen and and general home repairmen depend upon operating such caulking guns.

It is the primary object of the present invention to provide an electric hand-held type caulking gun wherein the power required to drive the piston through the gun is applied by means of an electric motor which, by the closing of an electric switch, will enable even a child to dispense caulking of the most viscous composition and at a continuous, easy-to-control flow, and in a manner unobtainable with conventional hand operated apparatus of this type.

It is a further object to provide a caulking gun of the type herein described wherein upon emptying of the caulking cartridge or upon any other form of forceful interrupted forward movement of the driven piston, a resistant spring type clutching mechanism effects an interruption of the motor drive to the piston thereby preventing damage to the housing or driving train mechanism of the gun during this overloading interval.

A further object is to provide an electrically driven caulking gun wherein the resiliant action of the spring portion of the clutch mechanism within the drive linkage between the motor and piston operates to yieldably respond, to the reacting pressure against the piston, to apply more or less pressure to the caulking being driven from the gun as the need requires and further operates to drivably disengage the motor from the piston should the reacting pressure against the piston exceed a predetermined value.

A still further object is to provide an electric caulking gun wherein the electric drive includes a variable speed control that will allow fast or slow dispensing of the caulking from the caulking cartridge as desired.

A further object is to provide an electric caulking gun including quick disengagement of the drive linkage from the piston after emptying of the cartridge thereby allowing the piston to be freed of the drive linkage to allow the piston to be manually movable through the gun.

Other objects and advantages will become more apparent when referring to accompanying description and drawings wherein:

FIG. 4 is a view partly in elevation and partly in section of the drive mechanism of the gun of FIG. 1.

FIG. 5 is a view in elevation of the drive plate as related to the gun piston and driven cam.

FIG. 6 is a fragmentary view partly in elevation and partly in section of the driving and driven plates as forced by the release screw to their piston freeing position.

FIG. 7 is a fragmentary section of the gun and showing as a cutaway a portion of the speed reducing linkage of the gun.

FIG. 8 is a fragmentary view partly in elevation and partly in section of an alternate form of drive plate clutch assembly as may be used within the drive train of the device.

Figure 1:
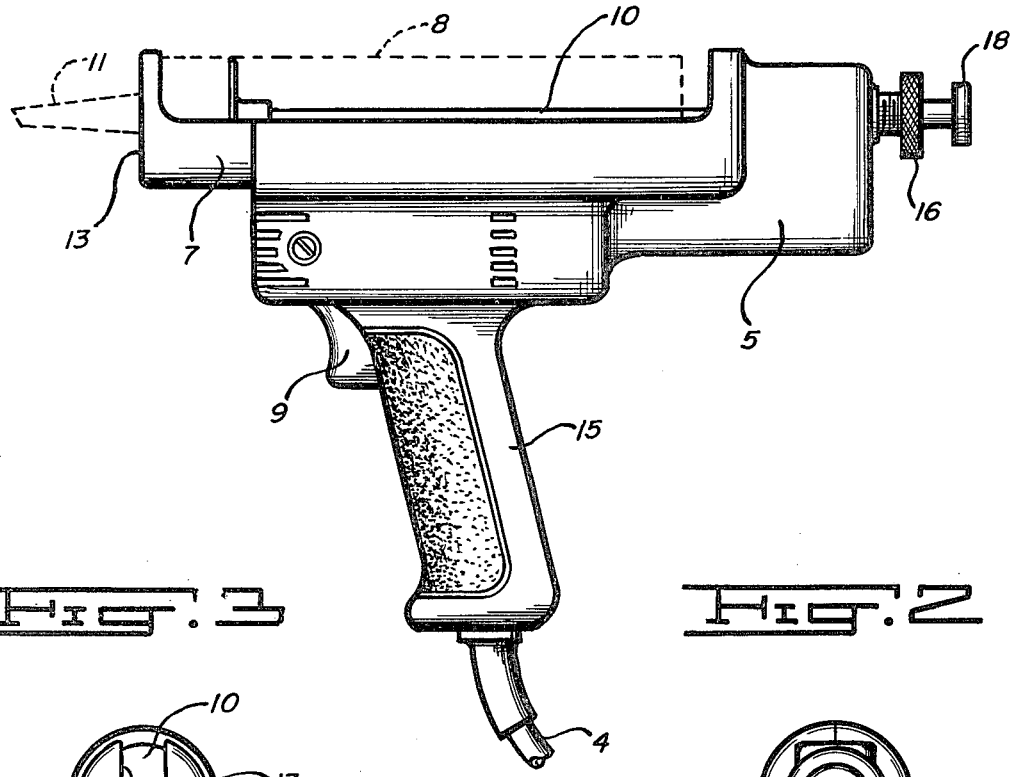
FIG. 1 is a side view in elevation of the caulking gun of the present invention.
Figure 3:
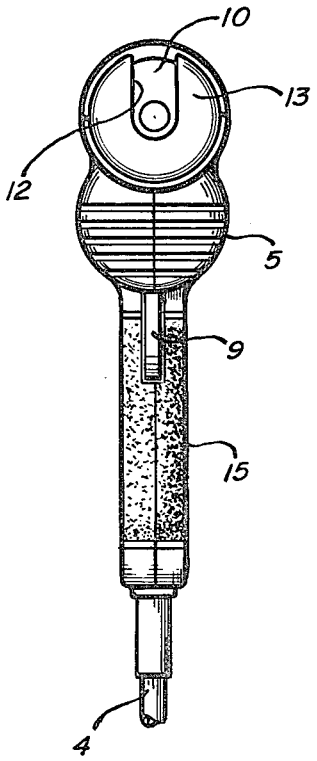
FIG. 3 is a front end view in elevation of the gun of FIG. 1.

Referring now to the drawings and particularly to FIG. 1 thereof wherein is shown a view of the gun in elevation and as including a plastic clam-shell type housing 5 suitably secured about the mechanism of the gun as shown. Fastened within the housing is a caulk receiving receptacle 7 preferably formed from aluminum for lightness and strength and wherein is received a caulk containing cartridge 8. When using the caulking gun, as herein shown, a cartridge is placed within the receptacle 7 whereon, by operation of the motor within the gun by depressing trigger 9, a piston 10 is caused to be forcefully driven through the cartridge as required to force caulking from the cartridge by way of the nozzle 11. The nozzle extends from the gun through a notch 12 formed within the forward plate 13 of the receptacle.

The handle portion of the gun 15 and including the trigger 9 and power supply cord 4, is shown as positioned well forward upon the gun case and thereby to more effectively balance the gun when supporting the weight of a caulking filled cartridge within the receptacle and provides a one hand operation of the gun. The trigger 9 is preferably of the long stroke type and shall include a variable speed control for the motor. A long stroke trigger, included in such a control, will provide for a more gradual control of the motor speed and thereby a more effective control of caulking flow from the gun.

Figure 2:
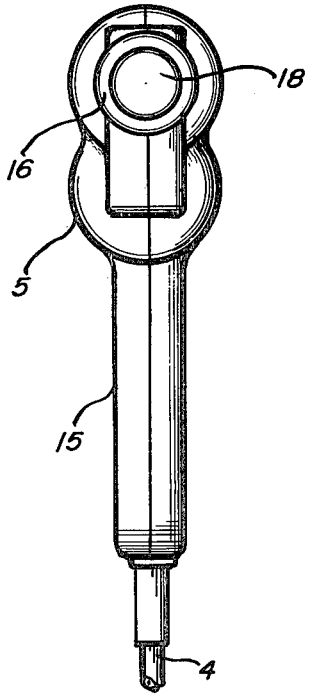
FIG. 2 is a rear view in elevation of the gun of FIG. 1.

From the rear of the gun, FIG. 2, extends the piston release screw 16. This screw operates to release the piston from its drive linkage for manual movement through the gun as will hereafter be more fully described.

In FIG. 4 is shown the piston driving mechanism of the gun as enclosed within a metallic housing 20. This housing is mechanically secured, as by screw 21, to the receptacle 7 whereby in this manner the high-stress metallic portions of the gun assembly are effectively secured together. The housing 20 is preferably formed as an aluminum die casting for lightness and through which extends the pistons 10. During gun operation, the piston is driven through the housing by means of a speed reducing drive linkage with the motor and at a rate controlled primarily by manipulation of trigger 9. The drive mechanism within the housing 20, is driven by way of a drive shaft 22 extending from a speed reducing gear cluster within the motor housing and as driven by the motor shaft gear 24.

The piston is driven through the receptacle towards its caulk driving position by movement of a substantially riggid steel driving plate 25 through which the piston extends, as shown in FIG. 5. In addition to the hole 26, the plate further includes a notch 27 of which the legs 28 thereof extend downward to straddle shaft 29 in a manner to stabilize the plate during its piston driving motion as will hereafter become more clearly apparent.

Mounted for rotation over shaft 29 is a gear 30 that includes a driving cam surface 31. Rotation of this gear, as driven by way of the speed reducing gear linkage with the motor shaft 24, effects reciprocal movement over shaft 29 of a driven cam member 32 that is maintained in bearing contact against the driving cam surface 31 as by spring 33.

Extending downward from the driven member 32 is a flange 34 that includes a notch that straddles the shaft guide 35. By this arrangement, the driven cam member is prevented from rotation as reciprocally driven over shaft 29 by rotation of the driving cam surface 31. Forward movement of the driven cam member 32 operates to drive forward the piston driving plate 25 maintained in bearing contact against the driven member 32 also by the spring 33. Plate 25 when in its tilted position, as shown in FIG. 4, is in gripping engagement with the piston 10 therefore when driven forward by the driven member 32 forcefully drives forward the piston through the receptacle of the gun. Forward movement of the piston with each cam stroke is determined by the length and pitch angle of the driving cam face 31 as applied to the resiprocating driven member 32 preferably upon which a similar formed cam face 37 is provided. While herein is shown in FIG. 4 the driving cam as including two cam faces 31, it is understood that one, three or more such faces between the driving and driven members will suffice. A single cam stroke of the driving cam may operate to advance the piston from say 1/16 inch to 3/16 inch or more. Springs 33, 40 and 41 operate to return the plate 25 and driven member 32 to their initial positions, as shown in FIG. 4 upon completion of each driving stroke of the drive cam 31.

Hingedly secured to the housing 20 as by shaft 48 is a holding plate 49. The piston extends through a hole in this plate in a similar manner to plate 25. The holding plate 49 is yieldably held in a tilted and piston gripping position by spring 40 that here is much stronger than spring 41. In operation, forward motion of the piston, whether driven manually or by the mechanism of the gun, carries forward the holding plate as required to momentarily disengage it from the piston shaft and thereby free the piston for forward movement through the gun. Upon a stopping of the piston, the spring 40 instantly operates to urge the plate 49 backward to its tilted and piston locking position to effectively hold the piston in its newly advanced position. This reciprocal operation of the piston driving and holding plates effects a gradual and forceful advance of the piston through the gun.

To free the piston of both the driving and holding plates for allowing manual movement of the piston, the release screw 16 is rotated inwardly and against plate 25 in a manner to force plate 25 forward and against spring 41. Sufficient forward movement of this drive plate serves to compress spring 41 to a substantially solid state, as shown in FIG. 6, to force the holding plate 49 forward and from its piston holding position. This operation serves to free the piston from both its driving and holding plates and allows the manual movement of the piston in either direction through the gun.

It will be noted that the reset or drop-off points 50 of the cams are at a slight angle. This structure provides for a rapid but not instantaneous reset of the cam surfaces thereby eliminating the noise or click instantaneous reset of the cams would produce as the cam surfaces snap together. As apparent, the piston is driven forward through the gun by clockwise rotation of the driving cam 31.

Because of the speed reduction required of the drive linkage between the motor and piston, a relatively small and lightly constructed motor will suffice to drive the piston through the gun with considerable force. Therefore, because of this developed force at the low speed end of the drive, there is provided within the drive linkage between the piston and motor a yieldable clutch mechanism and operable to yield in a manner to disengage drivably the motor from the piston should overloading or stopping of the piston occur during operation of the motor. Such a stopping of the piston could be caused by the piston reaching its most forwardly position within the cartridge or by the operator attempting to force old and set-up caulking from the gun. Such forceful stopping of the piston during motor operation could result in a binding up or damage to the drive mechanism of the gun or rupture of the plastic gun case. What must further be considered with such power operated guns, is the natural flow rate of the caulking being dispensed. Caulking of widely differing viscosities will flow at widely different rates from the same size discharge orifice in the nozzle under the same pressure conditions. Any attempt to forcefully accelerate this normal flow rate will result in rupture of the cartridge case. Here a yielding spring clutch mechanism is set to slip should the maximum force against the piston exceed a predetermined value and as herein set below the rupture point of the cartridge case.

Positioned in the drive train between the motor and piston is a clutching structure that includes in combination the driving cam 31 and a spring washer 51. This bow spring washer may be of of any suitable type and positioned between the driving cam 31 and housing 20. Upon a forceful stopping of the driven cam member 32, as by an arresting or predetermined retardation of movement of piston 10, the continuously rotating driving cam 31 is caused to force itself and gear 30 backwards along shaft 29 and against the spring washer 51. Sufficient compressing of the washer will cause the driving cam to override the driven cam 37 to thereby effect a shipping condition through the drive linkage between the motor and piston.

Further, such a clutching structure operates to automatically regulate the driving stroke of the cam face. The more force required to drive the caulking from the gun, the more the spring washer 51 is compressed. Flattening of this washer reduces the driving stroke of the driving cam and consequently the smaller the bight taken by the driving plate upon the piston. The smaller the plate bight the more forceful the piston is driven through the gun. When the reacting pressure against the piston exceeds the maximum operating pressure expected of the gun, the washer 51 is sufficiently flattened as to cause the driving cam to override the cam face of the driven cam to effect the necessary slippage in the drive linkage between the motor and piston. Such slippage in the drive linkage will serve to prevent damage to either the gun or drive mechanism should forceful stopping of the piston occur during operation of the motor. By this self-regulation of the clutching mechanism, the bight taken by the plate 25 upon the piston may vary from, as previously stated, 1/16 inch to 3/16 inch depending upon the required force necessary to drive the caulking from the gun.

In the device of FIG. 8 is shown an alternate form of clutching mechanism as positioned between the driving cam and piston and wherein instead of a riggid piston driving plate such as 25 of FIG. 4, the driving plate 60 is formed as a stiff but resistant spring strip that is so designed as to resiliently flex or yield as required to absorb the full driving stroke of the driving cam should forceful stopping of the piston 10 occur on the reacting pressure against the piston exceed the maximum operating pressure designed into the gun. In either instance, as in FIG. 4, the yielding nature of the resistant clutch like linkage within the drive mechanism of the gun and disposed between the motor and piston and as related to the cam stroke, will operate to absorb the full power stroke of the reciprocating cam face 31 should a stopping or a predetermined retardation of piston movement occur when being driven by the motor of the gun.

The mechanism of FIG. 8 requires a close correlation between the degree of deflection required of the spring piston driving plate 60 before the latter is overstressed to take on a permanent set and the required stiffness of the plate necessary to produce the maximum pressure required of the gun before an overriding of the cam surface takes place. Desirably, the power stroke of the driving cam shall be maintained as short as practical. The shorter and more rapid the cam strokes as related to the stiffness of the clutch spring or plate 60, the smoother the piston action as it is forcefully driven through the gun. Here the slipping point of the clutch is preset to disengage the drive between the motor and piston when the piston pressure exceeds say 100 psig. This operating pressure produced by the gun exceeds by at least three times the force generally applied to caulking dispensed from hand operated guns and yet is well within the rupture point of the cartridge case.

The structure of the device is such that the clutching system within the gun can be selectively regulated or adjusted for slip. A partial or selected degree of inward movement of the release screw 16 against the driving plate 25 will limit the backward movement of the plate and therefore shorten the bight the plate is capable of taking upon the piston. This, in effect, shortens the driving stroke of the driving cam face 31. By this manner of moving the driving plate away from the driving cam will operate to limit the cam's driving stroke and therefore selectively regulate the overriding point of the engaging cam faces and hence the slipping point of the clutch.

Describing briefly the operation of the gun. To free the piston for manual operation; the release screw 16 is rotated inwardly as required to disengage the piston from its driving linkage with the motor. The now free piston is manually retracted by knob 18 sufficiently as to place a caulking cartridge within the receptacle portion 7 of the gun. The piston is then manually directed against the base of the cartridge and the piston release screw retracted. This readies the gun for operation. A subsequent depressing of trigger 9 effects, by way of the drive linkage with the motor, rotation of the driving cam 31 which in turn and by its linkage with the piston driving plate 25 effects movement of the plate as required to drive the piston through the gun and therefore caulking from the nozzle 11.

The rate at which the piston is driven through the gun is determined primarily by the degree of movement as applied manually to the motor speed controlling trigger 9. The spring drive plate or yielding point of the spring washer 51 within the drive train between the motor and piston further operations, on the high side, to control piston travel and as determined by the flow rate of the particular caulking being dispensed. The slippable clutch will operate to prevent piston movement through the gun at a faster rate than the caulking can flow from the cartridge nozzle regardless of motor speed and as controlled by the trigger. It has been found that caulking flow from the gun can be effectively directed and controlled when dispensed at a rate represented by a piston travel of from 1 to 2 inches per minute depending upon the size of the discharge orifice in the nozzle.

In the mechanism shown in FIGS. 4 and 8, all piston driving parts shall be formed preferably from hardened steel, otherwise where practical, all parts throughout the gun shall be of the lightest material practical in order to produce a light rugged gun structure.

It is to be understood that throughout the device where needed, all bearing surfaces shall be of the oil impregnated type or better and suitable thrust bearings surfaces shall be provided where necessary throughout the gun in accordance with good manufacturing practice.

While herein is shown two forms of spring type clutch mechanisms that have been found suitable for mounting within the piston driving linkage, it is understood that other forms of clutch mechanisms will suffice.

While the reciprocating member is shown as including a cam face for receiving movement from the drive member 31 it is understood that motion may be applied to the reciprocating member 32 in any manner found suitable and from this member to the piston driving plate 25. The arrangement and disposition of the various parts within the gun may be selectively varied providing their operation produces the result desired.

What I therefore claim and desire to cover by letters patent is:

1. A hand held electric caulking gun including in combination, a receptable for receiving therein a caulk containing cartridge having a caulk dispensing nozzle, a piston movable when driven through said cartridge to force the caulking therein from said nozzle, means including a reciprocating surface, driving means for said reciprocating surface including an electric motor, a speed reducing drive train connecting said motor with said reciprocating surface whereby operation of said motor causes reciprocal movement of said surface, and a spring piston gripping plate movable by movement of said reciprocating surface to engage in gripping relation the surface of said piston to effect movement of said piston through said cartridge to force caulking therein from said nozzle, said spring piston gripping plate resiliently being yieldable to absorb the reciprocating movement of said reciprocating surface upon a predetermined movement arresting force being applied to the caulk driving end of said piston during operation of said motor.

2. A hand-held caulking gun as called for in claim 1 wherein within said piston gripping plate is formed a hole through which the piston extends and disposed to engage in gripping relation the surface of said piston upon movement of said plate when moved by movement of said reciprocating surface.

3. A caulking gun as called for in claim 1 wherein means movably operates to drivably disengage said spring piston gripping plate from said piston upon a predetermined further movement of said reciprocating surface.

4. A caulking gun as called for in claim 1 wherein holding means operate to hold said piston in its plate moved position.

5. A caulking gun as called for in claim 4 for wherein manually operable piston releasing means operate to release the piston from both the driving plate and holding means for allowing manual movement of said piston.

6. A caulking gun as called for in claim 4 wherein manually operable means operate to regulate movement of said piston driving plate.

7. A caulking gun as called for in claim 1 wherein the speed of said electric motor is selectively variable.

8. A hand-held electric caulking gun including in combination, a receptacle for receiving therein a caulk containing cartridge having a caulk dispensing nozzle thereon, a piston movable when driven through said cartridge to force the caulking therein from said nozzle, means including a cam surface, driving means for said cam surface including an electric motor, a speed reducing drive train connecting said motor with said cam surface whereby operation of said motor causes reciprocating movement of said cam surface, piston gripping means movable by reciprocating movement of said cam surface to engage in gripping relation the surface of said piston to effect movement of said piston through said cartridge to form the caulking therein from said nozzle and yieeldable spring clutch means interposed between said motor and piston and operative to yieldably absorb the reciprocal movement of said cam surface as required to drivably disengage the motor from the piston upon a predetermined movement retarding pressure being applied to the piston during operation of said motor.

9. A hand-held caulking gun as called for in claim 8 wherein said piston gripping means is in the form of a drive plate disposed to engage in gripping relation the surface of said piston responsive to movement of said cam surface.

10. A hand-held caulking gun as called for in claim 8 wherein said piston gripping means is in the form of a drive plate disposed about said piston and movable by reciprocal movement of said cam surface into driving relation with said piston.

11. A caulking gun as called for in claim 8 wherein means movable operates to drivably disengage said gripping means from said piston upon a predetermined further movement of said cam.

12. A caulking gun as called for in claim 11 including piston holding means movable to hold said piston in its driven position.

13. A caulking gun as called for in claim 12 including means for releasing said piston from both the driving and holding means to allow manual movement of said piston.

14. A caulking gun as called for in claim 8 wherein the said clutch means is interpositioned between said cam surface and said piston.

15. A caulking gun as called for in claim 8 wherein the said clutch means is interpositioned in said speed reducing drive train between said motor and said reciprocating cam surface.

16. A caulking gun as called for in claim 8 wherein said clutch means is slippable.

17. A caulking gun as called for in claim 16 wherein said clutch means is adjustable for slip.

18. A caulking gun as called for in claim 8 wherein the speed of said electric motor is selectively variable.

19. A hand-held electric caulking gun including in combination a receptacle for receiving therein a caulk containing cartridge having a caulk dispensing nozzle thereon, a piston movable when driven through said cartridge to force the caulking therein from said nozzle, driving means for said piston including a driving plate disposed about said piston and movable when driven to grip the surface of said piston to move said piston through said cartridge, driving means for said plate including a cam surface movable when driven to drive said plate, an electric motor, a speed reducing drive train connecting said motor with said cam and operable, upon operation of said motor, to drive said cam surface and spring clutch means disposed between said piston and motor and operative to yieldably interrupt movement between said motor and piston upon a predetermined movement retarding force being applied to said piston during operation of said motor.

20. A caulking gun as called for in claim 19 including piston holding means movable to hold said piston in its plate driven position.

21. A caulking gun as called for in claim 20 including means for releasing said piston from both the driving plate and holding means to allow manual movement of said piston.

22. A caulking gun as called for in claim 19 wherein said spring clutch means is interposed between said piston and cam surface.

23. A caulking gun as called for in claim 19 wherein the said spring clutch means is interposed in said speed reducing drive train between said motor and said cam surface.

24. A caulking gun as called for in claim 19 wherein said spring clutch means is slippable.

25. A caulking gun as called for in claim 19 wherein said spring clutch means is adjustable for slip.

26. A caulking gun as called for in claim 19 wherein the speed of said electric motor is selectively variable.

27. A hand-held electric caulking gun including in combination, a receptacle for receiving therein a caulk containing cartridge having a caulk dispensing nozzle thereon, a piston movable when driven through said cartridge to force the caulking therein from said nozzle, driving means for said piston including a drive plate movable when driven to grip the surface of said piston to drive said piston through said cartridge, an electric motor, reciprocating cam surface means, a speed reducing drive train connecting said motor with said reciprocating cam surface and operable when driven by said motor to cause movement of said cam surface, holding means movable to hold said piston in its plate driven position and spring clutch means disposed in said speed reducing drive train between said motor and piston and operative to drivably absorb motion between said motor and piston upon a predetermined movement arresting pressure being applied to the caulk driving end of said piston during operation of said motor.

28. A caulking gun as called for in claim 27 including means for releasing said piston from both the driving plate and holding means to allow manual movement of said piston.

29. A caulking gun as called for in claim 27 where said spring clutch means is interpositioned between said driving plate and said reciprocating surface.

30. A caulking plate as called for in claim 27 wherein said spring clutch means is interposed between said motor and said reciprocating surface.

31. A caulking gun as called for in claim 27 wherein said spring clutch is slippable.

32. A caulking gun as called for in claim 27 wherein said spring clutch is selectively adjustable for slip.

33. A caulking gun as called for in claim 27 wherein the speed of said electric motor is selectively variable.

* * * * *